US007472744B2

(12) United States Patent
Gorbounov et al.

(10) Patent No.: US 7,472,744 B2
(45) Date of Patent: Jan. 6, 2009

(54) MINI-CHANNEL HEAT EXCHANGER WITH REDUCED DIMENSION HEADER

(75) Inventors: Mikhail B. Gorbounov, South Windsor, CT (US); Parmesh Verma, Manchester, CT (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 11/794,273

(22) PCT Filed: Dec. 28, 2005

(86) PCT No.: PCT/US2005/047364

§ 371 (c)(1),
(2), (4) Date: Jun. 26, 2007

(87) PCT Pub. No.: WO2006/083450

PCT Pub. Date: Aug. 10, 2006

(65) Prior Publication Data

US 2008/0110608 A1 May 15, 2008

Related U.S. Application Data

(60) Provisional application No. 60/649,421, filed on Feb. 2, 2005.

(51) Int. Cl.
*F28F 9/04* (2006.01)

(52) U.S. Cl. ..... 165/178; 62/515

(58) Field of Classification Search ..... None
See application file for complete search history.

(56) References Cited

U.S. PATENT DOCUMENTS 2,297,633 A 9/1942 Philipp
2,591,109 A 4/1952 Wade
3,016,230 A * 1/1962 Cederstrom et al. ..... 165/148
3,920,069 A 11/1975 Mosier
4,088,182 A 5/1978 Basdekas et al.
4,382,468 A 5/1983 Hastwell
4,497,363 A 2/1985 Heronemus
4,607,689 A 8/1986 Mochida et al.
4,709,689 A * 12/1987 Simcox ..... 126/665
4,724,904 A 2/1988 Fletcher et al.
5,069,277 A * 12/1991 Nakamura et al. ..... 165/173

(Continued)

FOREIGN PATENT DOCUMENTS

CN 1611907 5/2005

(Continued)

*Primary Examiner*—Allen J. Flanigan
(74) *Attorney, Agent, or Firm*—Marjama Muldoon Blasiak & Sullivan LLP

(57) ABSTRACT

A heat exchanger includes a plurality of flat, multi-channel heat exchange tubes extending between spaced headers. Each heat exchange tube has its inlet end in fluid flow communication to an inlet header through a transition connector. The transition connector has a body defining a divergent flow path extending from an inlet opening in its inlet end to an outlet opening in its outlet end, and a tubular nipple extending outwardly from the inlet end of the divergent flow path through the wall of the inlet header. The tubular nipple defines a fluid flow path extending between the inlet end of the divergent flow path of the transition connector and the fluid chamber of the inlet header. The inlet header has a lateral dimension less then the lateral dimension of the heat exchange tube.

7 Claims, 2 Drawing Sheets

U.S. PATENT DOCUMENTS

| | | | | |
|---|---|---|---|---|
| 5,105,877 | A * | 4/1992 | Ando | 165/150 |
| 5,320,165 | A | 6/1994 | Hughes | |
| 5,341,870 | A | 8/1994 | Hughes et al. | |
| 5,415,223 | A | 5/1995 | Reavis et al. | |
| 5,517,757 | A | 5/1996 | Hayashi et al. | |
| 5,632,329 | A | 5/1997 | Fay | |
| 5,743,329 | A | 4/1998 | Damsohn et al. | |
| 5,826,649 | A | 10/1998 | Chapp et al. | |
| 5,934,367 | A | 8/1999 | Shimmura et al. | |
| 5,941,303 | A | 8/1999 | Gowan et al. | |
| 5,967,228 | A | 10/1999 | Bergman et al. | |
| 5,971,065 | A | 10/1999 | Bertilson et al. | |
| 6,024,086 | A * | 2/2000 | Rich | 126/664 |
| 6,340,055 | B1 * | 1/2002 | Yamauchi et al. | 165/174 |
| 6,397,937 | B1 * | 6/2002 | Ghiani | 165/140 |
| 6,546,998 | B2 | 4/2003 | Oh et al. | |
| 6,564,863 | B1 | 5/2003 | Martins | |
| 6,688,137 | B1 | 2/2004 | Gupte | |
| 6,688,138 | B2 | 2/2004 | DiFlora | |
| 6,810,951 | B1 * | 11/2004 | Dumetz | 165/173 |
| 7,011,149 | B2 * | 3/2006 | Fujita et al. | 165/173 |
| 2001/0004935 | A1 | 6/2001 | Sanada et al. | |
| 2003/0116308 | A1 | 6/2003 | Watanabe et al. | |
| 2003/0131981 | A1 * | 7/2003 | Kohler et al. | 165/178 |
| 2003/0155109 | A1 | 8/2003 | Kawakubo et al. | |

FOREIGN PATENT DOCUMENTS

| | | |
|---|---|---|
| EP | 0228330 | 7/1987 |
| FR | 1258044 | 4/1961 |
| JP | 2217764 | 8/1990 |
| JP | 4080575 | 3/1992 |
| JP | 6241682 | 9/1994 |
| JP | 7301472 | 11/1995 |
| JP | 8233409 | 9/1996 |
| JP | 63169497 A * | 7/1999 |
| JP | 11351706 | 12/1999 |
| JP | 2002022313 | 1/2002 |
| WO | WO-0242707 | 5/2002 |

* cited by examiner

MINI-CHANNEL HEAT EXCHANGER WITH REDUCED DIMENSION HEADER

CROSS-REFERENCE TO RELATED APPLICATION

Reference is made to and this application claims priority from and the benefit of U.S. Provisional Application Ser. No. 60/649,421, filed Feb. 2, 2005, and entitled MINI-CHANNEL HEAT EXCHANGER WITH REDUCED HEADER, which application is incorporated herein in its entirety by reference.

FIELD OF THE INVENTION

This invention relates generally to heat exchangers having a plurality of parallel tubes extending between a first header and a second header and, more particularly, to improving fluid flow distribution amongst the tubes receiving fluid flow from the header of a heat exchanger, for example a heat exchanger in a refrigerant vapor compression system.

BACKGROUND OF THE INVENTION

Refrigerant vapor compression systems are well known in the art. Air conditioners and heat pumps employing refrigerant vapor compression cycles are commonly used for cooling or cooling/heating air supplied to a climate controlled comfort zone within a residence, office building, hospital, school, restaurant or other facility. Refrigerant vapor compression systems are also commonly used for cooling air to provide a refrigerated environment for food items and beverage products within display cases in supermarkets, convenience stores, groceries, cafeterias, restaurants and other food service establishments.

Conventionally, these refrigerant vapor compression systems include a compressor, a condenser, an expansion device, and an evaporator connected in refrigerant flow communication. The aforementioned basic refrigerant system components are interconnected by refrigerant lines in a closed refrigerant circuit and arranged in accord with the vapor compression cycle employed. An expansion device, commonly an expansion valve or a fixed-bore metering device, such as an orifice or a capillary tube, is disposed in the refrigerant line at a location in the refrigerant circuit upstream with respect to refrigerant flow of the evaporator and downstream of the condenser. The expansion device operates to expand the liquid refrigerant passing through the refrigerant line running from the condenser to the evaporator to a lower pressure and temperature. In doing so, a portion of the liquid refrigerant traversing the expansion device expands to vapor. As a result, in conventional refrigerant vapor compression systems of this type, the refrigerant flow entering the evaporator constitutes a two-phase mixture. The particular percentages of liquid refrigerant and vapor refrigerant depend upon the particular expansion device employed and the refrigerant in use, for example R-12, R-22, R-134a, R404A, R-410A, R-407C, ammonia, carbon dioxide or other compressible fluid.

In some refrigerant vapor compression systems, the evaporator is a parallel tube heat exchanger. Such heat exchangers have a plurality of parallel refrigerant flow paths therethrough provided by a plurality of tubes extending in parallel relationship between an inlet header and an outlet header. The inlet header receives the refrigerant flow from the refrigerant circuit and distributes the refrigerant flow amongst the plurality of flow paths through the heat exchanger. The outlet header serves to collect the refrigerant flow as it leaves the respective flow paths and to direct the collected flow back to the refrigerant line for return to the compressor in a single pass heat exchanger or through an additional bank of heat exchange tubes in a multi-pass heat exchanger.

Historically, parallel tube heat exchangers used in such refrigerant vapor compression systems have used round tubes, typically having a diameter of ⅜ inch or 7 millimeters. More recently, flat, rectangular dimension, multi-channel tubes are being used in heat exchangers for refrigerant vapor compression systems. Each multi-channel tube has a plurality of flow channels extending longitudinally in parallel relationship the length of the tube, each channel providing a small flow area refrigerant flow path. Thus, a heat exchanger with multi-channel tubes extending in parallel relationship between the inlet and outlet headers of the heat exchanger will have a relatively large number of small flow area refrigerant flow paths extending between the two headers. In contrast, a parallel tube heat exchanger with conventional round tubes will have a relatively small number of large flow area flow paths extending between the inlet and outlet headers.

A problem associated with heat exchangers having flat, rectangular tubes extending between an inlet header and an outer header versus heat exchangers having round tubes is the connection of the inlet ends of the tubes to the inlet header. Conventionally, the inlet header is an axially elongated cylinder of circular cross-section provided with a plurality of rectangular slots cut in its wall at axially spaced intervals along the length of the header. Each slot is adapted to receive the inlet end of one of the flat, rectangular heat exchange tubes with the inlets to the various flow channels open to the chamber of the header, whereby fluid within the chamber of the inlet header may flow into the multiple flow channels of the various heat exchange tubes opening into the chamber. As the flat, rectangular heat exchange tubes have a lateral dimension significantly greater than the diameter of conventional round tubes, the diameters of the round cylindrical headers associated with conventional flat tube heat exchangers are significantly greater than the diameters of headers associated with round tube heat exchangers for a comparable volumetric fluid flow rate.

Non-uniform distribution, also referred to as maldistibution, of two-phase refrigerant flow is common problem in parallel tube heat exchangers which adversely impacts heat exchanger efficiency. Two-phase maldistribution problems are caused by the difference in density of the vapor phase refrigerant and the liquid phase refrigerant present in the inlet header due to the expansion of the refrigerant as it traversed the upstream expansion device.

One solution to control refrigeration flow distribution through parallel tubes in an evaporative heat exchanger is disclosed in U.S. Pat. No. 6,502,413, Repice et al. In the refrigerant vapor compression system disclosed therein, the high pressure liquid refrigerant from the condenser is partially expanded in a conventional in-line expansion value upstream of the heat exchanger inlet header to a lower pressure, liquid refrigerant. A restriction, such as a simple narrowing in the tube or an internal orifice plate disposed within the tube, is provided in each tube connected to the inlet header downstream of the tube inlet to complete expansion to a low pressure, liquid/vapor refrigerant mixture after entering the tube.

Another solution to control refrigeration flow distribution through parallel tubes in an evaporative heat exchanger is disclosed in Japanese Patent No. JP4080575, Kanzaki et al. In the refrigerant vapor compression system disclosed therein, the high pressure liquid refrigerant from the condenser is also partially expanded in a conventional in-line expansion value to a lower pressure, liquid refrigerant upstream of a distribution chamber of the heat exchanger. A plate having a plurality of orifices therein extends across the chamber. The lower pressure liquid refrigerant expands as it passes through the orifices to a low pressure liquid/vapor mixture downstream of the plate and upstream of the inlets to the respective tubes opening to the chamber.

Japanese Patent No. JP2002022313, Yasushi, discloses a parallel tube heat exchanger wherein refrigerant is supplied to the header through an inlet tube that extends along the axis of the header to terminate short of the end the header whereby the two phase refrigerant flow does not separate as it passes from the inlet tube into an annular channel between the outer surface of the inlet tube and the inside surface of the header. The two phase refrigerant flow thence passes into each of the tubes opening to the annular channel.

Obtaining uniform refrigerant flow distribution amongst the relatively large number of small flow area refrigerant flow paths is even more difficult than it is in conventional round tube heat exchangers and can significantly reduce heat exchanger efficiency. Two-phase maldistribution problems may be exacerbated in inlet headers associated with conventional flat tube heat exchangers due to the lower fluid flow velocities attendant to the larger diameter of such headers. At lower fluid flow velocities, the vapor phase fluid more readily separates from the liquid phase fluid. Thus, rather than being a relatively uniform mixture of vapor phase and liquid phase fluid, the flow within the inlet header will be stratified to a greater degree with a vapor phase component separated from the liquid phase component. As a consequence, the fluid mixture will undesirably be non-uniformly distributed amongst the various tubes, with each tube receiving differing mixtures of vapor phase and liquid phase fluid.

In U.S. Pat. No. 6,688,138, DiFlora discloses a parallel, flat tube heat exchanger having an inlet header formed of an elongated outer cylinder and an elongated inner cylinder disposed eccentrically within the outer cylinder thereby defining a fluid chamber between the inner and outer cylinders. The inlet end of each of the flat, rectangular heat exchange tubes extend through the wall of the outer cylinder to open into the fluid chamber defined between the inner and outer cylinders.

Japanese Patent No. 6241682, Massaki et al., discloses a parallel flow tube heat exchanger for a heat pump wherein the inlet end of each flat, multi-channel tube connecting to the inlet header is crushed to form a partial throttle restriction in each tube just downstream of the tube inlet. Japanese Patent No. JP8233409, Hiroaki et al., discloses a parallel flow tube heat exchanger wherein a plurality of flat, multi-channel tubes connect between a pair of headers, each of which has an interior which decreases in flow area in the direction of refrigerant flow as a means to uniformly distribute refrigerant to the respective tubes.

SUMMARY OF THE INVENTION

It is a general object of the invention to reduce maldistribution of fluid flow in a heat exchanger having a plurality of multi-channel tubes extending between a first header and a second header.

It is an object of one aspect of the invention to reduce maldistribution of refrigerant flow in a refrigerant vapor compression system heat exchanger having a plurality of multi-channel tubes extending between a first header and a second header.

It is an object of one aspect of the invention to distribute two-phase refrigerant flow in a relatively uniform manner in a refrigerant vapor compression system heat exchanger having a plurality of multi-channel tubes extending between a first header and a second header.

In one aspect of the invention, a heat exchanger is provided having a header defining a reduced dimension chamber for receiving a fluid, and a plurality of heat exchange tubes having a plurality of fluid flow paths therethrough from an inlet end to an outlet end of the tube, each tube having an inlet in fluid communication with the reduced dimension header through a transition connector. Each transition connector has an inlet end in fluid flow communication with the chamber of the header through a first opening and an outlet end in fluid communication with the inlet opening of a respective one of the plurality of heat exchange tubes. Each transition connector defines a divergent fluid flow path extending from its inlet end to its outlet end. The reduced dimension header defines a chamber having a reduced volume and a reduced flow area whereby greater turbulence is present in the fluid flow passing through the header. The inlet opening of each transition connector has a small flow area smaller in comparison to the flow area of the chamber of the header so as to provide a flow restriction through which fluid passes in flowing from the chamber of the header into the divergent flow path of the connector. The flow restriction results in a pressure drop which through each connector which promotes uniform distribution amongst the respective heat exchange tubes and may also provide for partial expansion of the fluid passing through the connector.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION OF THE INVENTION

Figure 1:
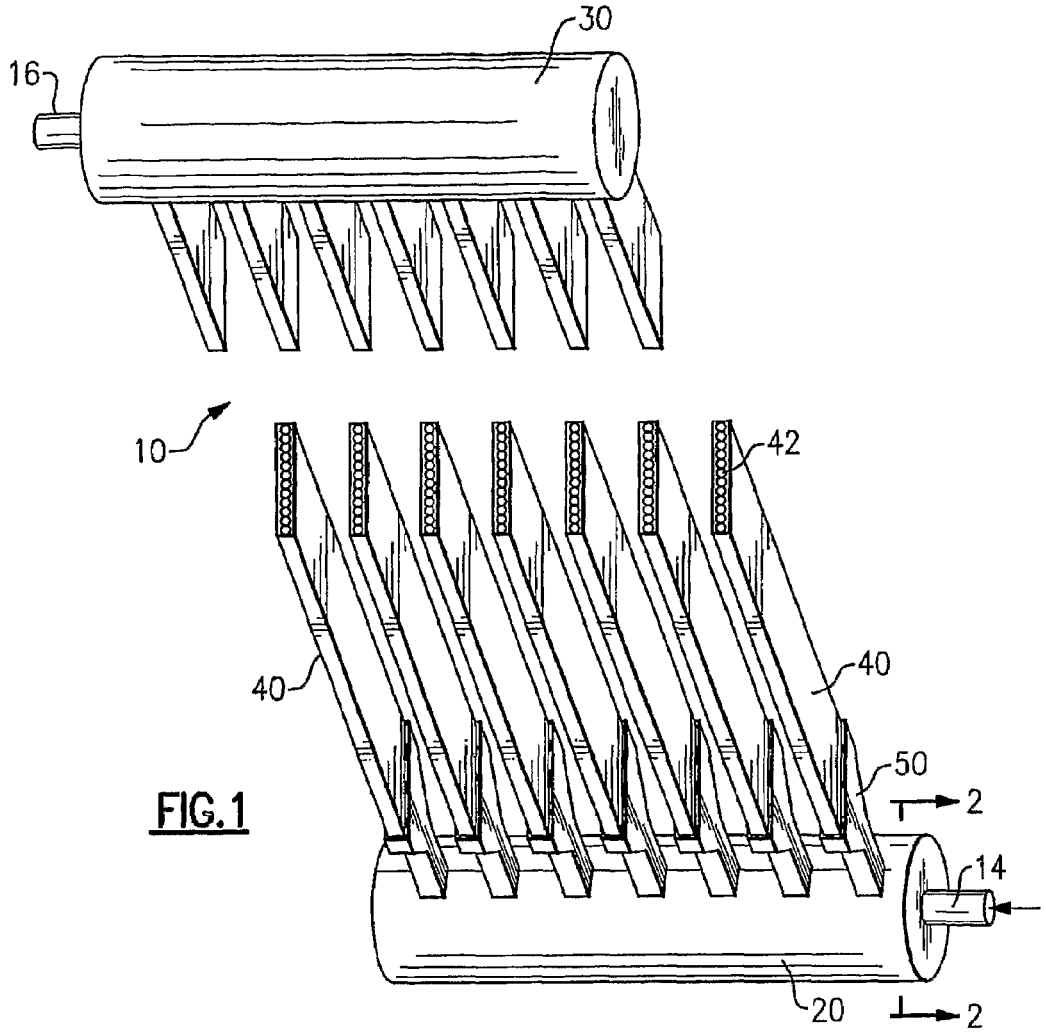
FIG. 1 is a perspective view of an embodiment of a heat exchanger in accordance with the invention.
Figure 5:
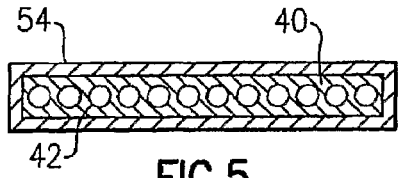
FIG. 5 is a sectioned view taken along line 5-5 of FIG. 2.
Figure 4:
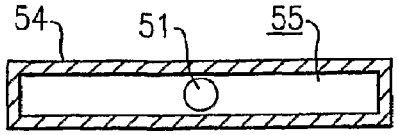
FIG. 4 is a sectioned view taken along line 4-4 of FIG. 3.

The heat exchanger 10 of the invention will be described in general herein with reference to the illustrative single pass, parallel tube embodiment of a multi-channel tube heat exchanger as depicted in FIG. 1. In the illustrative embodiments of the heat exchanger 10 depicted in FIG. 1, the heat exchange tubes 40 are shown arranged in parallel relationship extending generally vertically between a generally horizontally extending inlet header 20 and a generally horizontally extending outlet header 30. However, the depicted embodiment is illustrative and not limiting of the invention. It is to be understood that the invention described herein may be practiced on various other configurations of the heat exchanger 10. For example, the heat exchange tubes may be arranged in parallel relationship extending generally horizontally between a generally vertically extending inlet header and a generally vertically extending outlet header. As a further example, the heat exchanger could have a toroidal inlet header and a toroidal outlet header of a different diameter with the heat exchange tubes extend either somewhat radially inwardly or somewhat radially outwardly between the toroidal headers. In such an arrangement, although not physically parallel to each other, the tubes are in a "parallel flow" arrangement in that those tubes extend between common inlet and outlet headers.

Referring now to FIGS. 1-5 in particular, the heat exchanger 10 includes an inlet header 20, an outlet header 30, and a plurality of longitudinally extending multi-channel heat exchanger tubes 40 thereby providing a plurality of fluid flow paths between the inlet header 20 and the outlet header 30.

Each heat exchange tube 40 has an inlet at its inlet end 43 in fluid flow communication to the inlet header 20 through a transition connector 50 and an outlet at its other end in fluid flow communication to the outlet header 30.

Each heat exchange tube 40 has a plurality of parallel flow channels 42 extending longitudinally, i.e. along the axis of the tube, the length of the tube thereby providing multiple, independent, parallel flow paths between the inlet of the tube and the outlet of the tube. Each multi-channel heat exchange tube 40 is a "flat" tube of flattened rectangular, or oval, cross-section defining an interior which is subdivided to form a side-by-side array of independent flow channels 42. The flat, multi-channel tubes 40 may, for example, have a width of fifty millimeters or less, typically twelve to twenty-five millimeters, and a depth of about two millimeters or less, as compared to conventional prior art round tubes having a diameter of either ½ inch, ⅜ inch or 7 mm. The tubes 40 are shown in drawings hereof, for ease and clarity of illustration, as having twelve channels 42 defining flow paths having a circular cross-section. However, it is to be understood that in commercial applications, such as for example refrigerant vapor compression systems, each multi-channel tube 40 will typically have about ten to twenty flow channels 42, but may have a greater or a lesser multiplicity of channels, as desired. Generally, each flow channel 42 will have a hydraulic diameter, defined as four times the flow area divided by the perimeter, in the range from about 200 microns to about 3 millimeters, and commonly about 1 millimeter. Although depicted as having a circular cross-section in the drawings, the channels 42 may have a rectangular cross-section or any other desired non-circular cross-section.

Each of the plurality of heat exchange tubes 40 of the heat exchanger 10 has its inlet end 43 inserted into the outlet end of a transition connector 50, rather than directly into the chamber 25 defined within the inlet header 20. Each transition connector 50 has a body having an inlet end and an outlet end and defining a fluid flow path 55 extending from a flow inlet 51 in the inlet end thereof and a flow outlet 59 the outlet end thereof, and a longitudinally elongated, tubular nipple 56 extending axially outwardly from the flow inlet 51. The nipple 56 defines a flow channel 53 extending longitudinally from a flow inlet 57 at the distal end of the nipple 56 to a flow outlet at its proximal end opening to the flow inlet 51 to the fluid flow path 55. The cross-section of the nipple 56 and its flow channel 53 may be circular, elliptical, hexagonal, rectangular or other desired cross-sectional configuration. The distal end of the nipple 56 of each transition connector 50 extends through the wall of the header 20 and is secured thereto in a conventional manner, typically by welding, brazing or other bonding technique. With the distal end of the nipple 56 extending into the chamber 25 of the header 20, fluid flow may pass from the chamber 25 through the inlet 57 into the flow channel 53, thence through the flow channel 53 and the inlet 51 to the flow path 55, and thence into the various flow channels 42 of the multi-channel tube 40.

Figure 6:
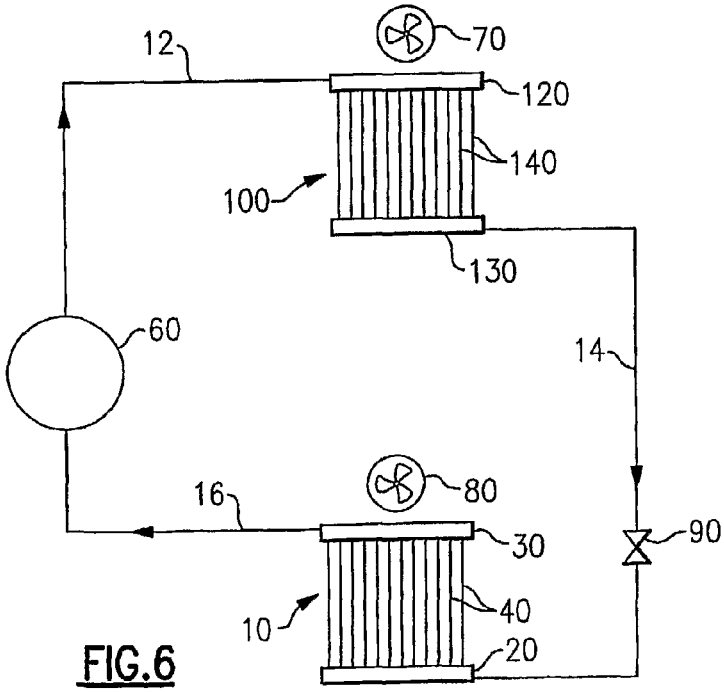
FIG. 6 is a schematic illustration of a refrigerant vapor compression system incorporating the heat exchanger of the invention as an evaporator.

Referring now to FIG. 6, there is depicted schematically a refrigerant vapor compression system having a compressor 60, the heat exchanger 100, functioning as a condenser, and the heat exchanger 10, functioning as an evaporator, connected in a closed loop refrigerant circuit by refrigerant lines 12, 14 and 16. As in conventional refrigerant vapor compression systems, the compressor 60 circulates hot, high pressure refrigerant vapor through refrigerant line 12 into the inlet header 120 of the condenser 100, and thence through the heat exchanger tubes 140 of the condenser 100 wherein the hot refrigerant vapor condenses to a liquid as it passes in heat exchange relationship with a cooling fluid, such as ambient air which is passed over the heat exchange tubes 140 by the condenser fan 70. The high pressure, liquid refrigerant collects in the outlet header 130 of the condenser 100 and thence passes through refrigerant line 14 to the inlet header 20 of the evaporator 10.

The condensed refrigerant liquid passes through an expansion valve 50 operatively associated with the refrigerant line 14 as it passes from the condenser 100 to the evaporator 10. In the expansion valve 90, the high pressure, liquid refrigerant is partially expanded to lower pressure, liquid refrigerant or a liquid/vapor refrigerant mixture. The refrigerant thence passes through the heat exchanger tubes 40 of the evaporator 10 wherein the refrigerant is heated as it passes in heat exchange relationship with air to be cooled which is passed over the heat exchange tubes 40 by the evaporator fan 80. The refrigerant vapor collects in the outlet header 30 of the evaporator 10 and passes therefrom through refrigerant line 16 to return to the compressor 60 through the suction inlet thereto.

Figure 2:
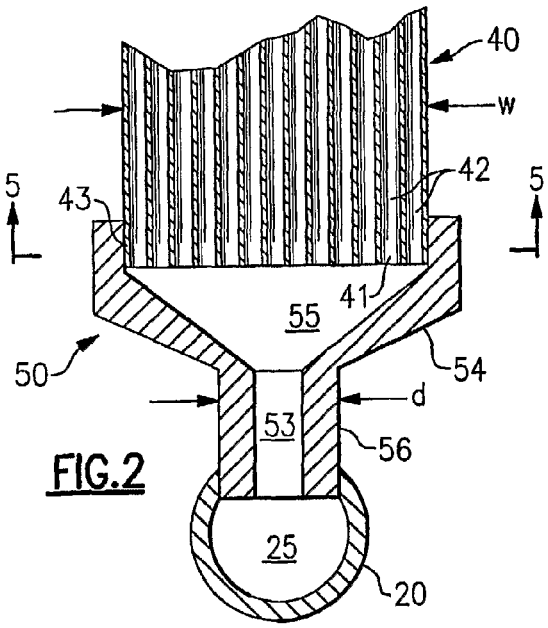
FIG. 2 is an elevation view, partly sectioned, taken along line 2-2 of FIG. 1.
Figure 3:
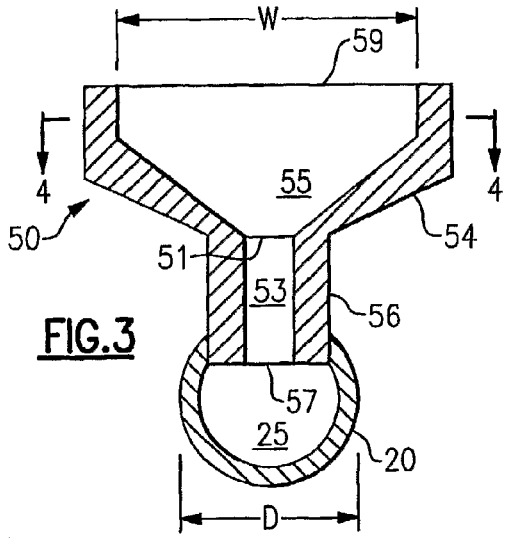
FIG. 3 is a sectioned elevation view of the transition connector of FIG. 2.

As best illustrated in FIGS. 2 and 3, the nipple 56 of the transition connector 50 has a lateral dimension that is substantially smaller than the width of the "flat" rectangular tube 40. Because the distal end of the nipple 56, which has a relatively small lateral dimension, d, and may be of circular cross-section, is received by the header 20, as opposed to the end of the flat tube 40, which has a relatively wide lateral dimension, W, the lateral dimension, D, of the header 20 can be made substantially smaller than the width of the tube 40. Therefore, the cross- section flow area of the chamber 25 of the header 20 will be significantly reduced as compared to a header designed to receive the inlet end 43 of a tube 40. Consequently, the fluid flow flowing through the chamber 25 of the header 20 will have a higher velocity and will be significantly more turbulent. The increased turbulence will induce more thorough mixing within the fluid flowing through the header 20 and result in a more uniform distribution of fluid flow amongst the tubes 40. This is particularly true for mixed liquid/vapor flow, such as a refrigerant liquid/vapor mixture which is the typical state of flow delivered into the inlet header of an evaporator heat exchanger in a vapor compression system operating in a refrigeration, air conditioning or heat pump cycle. The increased turbulence within the reduced dimension header will induce uniform mixing of the liquid phase refrigerant and the vapor phase refrigerant and reduce potential stratification of the vapor phase and the liquid phase within the refrigerant passing through the header.

Additionally, because the distal end of the nipple 56 has a relatively small lateral dimension, d, as opposed to the end of the flat tube 40, which has a relatively wide lateral dimension, W, the lateral dimension, D, of the header 20 will have a diameter substantially smaller than the diameter of a header designed to receive the inlet end 43 of a tube 40. Having a smaller diameter, the header may also have a smaller thickness. Therefore, the reduced diameter header of the heat exchanger of the invention will require significantly less material to manufacture and be less expensive to manufacture.

As noted previously, the flat, multi-channel tubes 40 may have a width of fifty millimeters or less, typically twelve to twenty-five millimeters, as compared to conventional prior art round tubes having a diameter of either ½ inch, ⅜ inch or 7 mm. In refrigeration systems having a condenser heat exchanger and an evaporator heat exchanger, the nipple 56 will generally have a lateral dimension, which assuming the nipple is a circular cylinder, an outer diameter, on the order of a conventional round refrigerant tube or smaller, typically in the range of three millimeters to eight millimeters By way of example, assuming that the nipple 56 is a cylinder having an outer diameter, d, of 6 millimeters, and that the flat tube is a rectangular tube 40 having a lateral dimension, W, of 15 millimeters. If the header 20 was designed to directly receive the end 43 of the tube 40, the lateral dimension, D, of the header 20 would need to be greater then 15 millimeters, for example 18 millimeters. However, if the header 20 only received the distal end of the nipple 56, the lateral dimension, D, of the header 20 would only need to be greater than 6 millimeters, for example 9 millimeters. For cylindrical headers, the flow area of the latter header would be only one-fourth the flow area of the former header, and the velocity within the latter header would be four times greater than the flow velocity within the former header, assuming equal volume flow rates.

In the depicted embodiment, the inlet header 20 comprises a longitudinally elongated, hollow, closed end cylinder having a circular cross-section. The distal end 57 of the nipple 56 of each transition connector 50 is mated with a corresponding opening 26 provided in and extending through the wall of the inlet header 20. Each connector may be brazed, welded, adhesively bonded or otherwise secured in a corresponding mating slot in the wall of the header 20. However, the inlet header 20 is not limited to the depicted configuration. For example, the header 20 might comprise a longitudinally elongated, hollow, closed end cylinder having an elliptical cross-section or a longitudinally elongated, hollow, closed end body having a square, rectangular, hexagonal, octagonal, or other desired cross-section. Irrespective of the configuration of the inlet header 20, its lateral dimension, D, needs only be large enough to accommodate the nipple 56, not nearly as wide as a similarly shaped header sized to directly receive the inlet end 43 of a flat, rectangular heat exchange tube 40.

Although the exemplary refrigerant vapor compression cycle illustrated in FIG. 6 is a simplified air conditioning cycle, it is to be understood that the heat exchanger of the invention may be employed in refrigerant vapor compression systems of various designs, including, without limitation, heat pump cycles, economized cycles and commercial refrigeration cycles. Further, those skilled in the art will recognize that the heat exchanger of the invention is not limited to the illustrated single pass embodiments, but may also be arranged in various single pass embodiments and multi-pass embodiments. Additionally, the heat exchanger of the present invention may be used as a multi-pass condenser, as well as a multi-pass evaporator in such refrigerant vapor compression systems.

Further, the depicted embodiment of the heat exchanger 10 is illustrative and not limiting of the invention. It is to be understood that the invention described herein may be practiced on various other configurations of the heat exchanger 10. For example, the heat exchange tubes may be arranged in parallel relationship extending generally horizontally between a generally vertically extending inlet header and a generally vertically extending outlet header.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A heat exchanger comprising:

at least one heat exchange tube defining a plurality of discrete fluid flow paths therethrough and having an inlet opening to said plurality of fluid flow paths, said at least one heat exchange tube being of generally rectangular shape and having a lateral dimension, W;

a header defining a chamber for collecting a fluid, said header being an elongated tubular member having a lateral dimension, D, the lateral dimension D being less than the lateral dimension W; and a transition connector having a body having an inlet end and an outlet end and defining a divergent fluid flow path expanding therebetween in cross-section in the direction of fluid flow therethrough, and a tubular nipple extending outwardly from said body and defining a fluid flow passage between the chamber of said header and the fluid flow path through said body of said transition connector.

2. A heat exchanger as recited in claim 1 wherein the outlet end of the body of said transition connector is adapted to receive said at least one heat exchange tube, and said nipple extends outwardly from the inlet end of said body.

3. A heat exchanger as recited in claim 1 wherein said tubular nipple of said transition connector has an outlet opening to said fluid flow path therethrough at a distal end of said nipple and in flow communication with the inlet end of said body of said transition connector and an inlet opening to said fluid flow path therethrough at a proximal end of said nipple and in fluid flow communication with the chamber of said header.

4. A heat exchanger as recited in claim 1 wherein said tubular nipple is a cylindrical tubular member having a relatively small diameter, d, the diameter d being less than the lateral dimension W and less than the lateral dimension D.

5. A heat exchanger comprising:

at least one heat exchange tube defining a plurality of discrete fluid flow paths extending from an inlet end to an outlet end thereof, said at least one heat exchange tube having a generally flattened cross-section having a lateral dimension, W;

a header defining a chamber for collecting a fluid, said header being an elongated tubular member having a lateral dimension, D, the lateral dimension D is less than the lateral dimension W; and a transition connector having a body and a tubular nipple extending outwardly from said body, said body defining a fluid flow path diverging from a first end in fluid communication with said tubular nipple to a second end in fluid communication with the plurality of discrete fluid flow paths of said at least one heat exchange tube, said tubular nipple defining a fluid flow passage between the chamber of said header and the fluid flow path through said body of said transition connector, said tubular nipple having a lateral dimension d, the lateral dimension d being less than the lateral dimension W.

6. A heat exchanger as recited in claim 5 wherein said at least one heat exchange tube has a rectangular cross-section.

7. A heat exchanger as recited in claim 5 wherein said at least one heat exchange tube has an oval cross-section.

* * * * *